United States Patent [19]

Garrison

[11] 3,976,408

[45] Aug. 24, 1976

[54] FLUID DRIVEN MOTOR HAVING IMPROVED BLADE CONSTRUCTION

[75] Inventor: Marion A. Garrison, Denver, Colo.

[73] Assignee: Empire Oil Tool Company, Denver, Colo.

[22] Filed: Jan. 31, 1975

[21] Appl. No.: 545,866

[52] U.S. Cl. ..... 418/153; 418/268

[51] Int. Cl.[2] ..... F01C 5/02; F03C 3/00; F04C 5/00

[58] Field of Search ..... 418/153, 154, 156, 268; 175/107

[56] References Cited

UNITED STATES PATENTS

| | | | |
|---|---|---|---|
| 2,636,478 | 4/1953 | Smyser | 418/153 |
| 2,738,775 | 3/1956 | Smyser | 418/153 |
| 2,753,809 | 7/1956 | Garrison | 418/153 |
| 2,882,868 | 4/1959 | Smyser | 418/153 |
| 3,594,106 | 7/1971 | Garrison | 418/153 |

FOREIGN PATENTS OR APPLICATIONS

| | | | |
|---|---|---|---|
| 786,999 | 11/1957 | United Kingdom | 418/153 |

*Primary Examiner*—John J. Vrablik
*Attorney, Agent, or Firm*—Vincent G. Gioia; Robert F. Dropkin

[57] ABSTRACT

A positive-displacement fluid driven motor for use with down-hole drilling tools includes a cylindrical housing having a bore in which is mounted a rotor having folding blades mounted thereon with a peripheral space therebetween. Separators on the walls of the bore separate the space into a plurality of fluid chambers having inlet ports at the trailing ends of the separators. Discharge ports are located a short distance from the leading ends of the separators. Each blade is supported at its center of pressure to limit the outward angular displacement of the blade and transmit the driving force to the rotor and also minimize binding of the blade due to the effects of the fluid pressure. The operative part of each blade is capable of limited inward linear movement in its direction of width against its inherent elasticity to accommodate imperfections in the walls of the bore and particles of grit or sand at its sealing edge to minimize wear.

12 Claims, 3 Drawing Figures

FLUID DRIVEN MOTOR HAVING IMPROVED BLADE CONSTRUCTION

This invention relates to improvements in fluid motors or pumps of the kind which are particularly, but not exclusively, suitable for use as down-hole motors in deep well drilling.

BACKGROUND OF THE INVENTION

In the drilling of deep wells the drilling bit may be driven by a positive-displacement type motor located down the hole towards the lower end of a drilling string composed of a number of sections through which liquid mud is fed under pressure to drive the motor, scavenge the hole around the bit and carry away cuttings and the like upwardly to the surface through the annular space between the drilling string and the surrounding wall of the hole.

In order to generate the necessary torque in the motor to drive the drilling bit, high liquid mud pressures are required and the motor is exposed to onerous operating conditions by virtue of such pressures and the nature of the driving liquid.

One particularly suitable type of positive displacement motor comprises a rotor rotatable in a housing with the annular space between the rotor and the housing divided into at least two chambers by longitudinally extending separators secured to the wall of the housing with a plurality of flexible blades attached to the rotor so that they swing out and engage the housing wall in fluid sealing relationship under the pressure of the liquid mud admitted to the chambers and fold inwardly when they engage the separator strips. The number of blades corresponds to or is a multiple of the number of chambers and as they pass a separator they are exposed to an inlet for the liquid mud and as they reach a separator the liquid mud escapes through an outlet, thus relieving the pressure on the blades and allowing them to fold inwardly.

Examples of such motors are disclosed in my U.S. Pat. Nos. 2,852,230 dated Sept. 16, 1956; 3,076,514 dated Feb. 5, 1963; and 3,594,106 dated July 20, 1971. Such motors disclosed in the prior art referred to are undoubtedly useful in the down-hole drilling of wells but it will be appreciated that the blades are exposed to extremely high liquid mud pressures in order to generate the necessary driving torque. Because of such high fluid pressures and the nature of the driving fluid, the motors operate under extremely onerous conditions and any improvement serving to increase the life of the motor under field operating conditions is important.

It is essential to maintain a good fluid-tight seal between the moving longitudinal edges of the blades and the wall of the housing so that fluid pressure should not be lost and the efficiency of the motor reduced. At the same time this is the area at which wear is most likely to occur due to friction and rubbing and entrained particles in the liquid mud.

In my above referred to United States patents the blades are mounted in longitudinally extending slots in the rotor and in U.S. Pat. Nos. 2,852,230 and 3,076,514, the inner edges of the blades are backed against and fully supported by a wall of the slot which limits the outward swing of the blades when exposed to fluid pressure. As is recognized in my U.S. Pat. No. 3,594,106, this results in the outer unsupported part of the blade tending to roll back about the outer inclined edge of the slot when exposed to fluid pressure thereby increasing the load on the blade and the tendency for the blade to lock against the wall of the housing. In order to reduce this problem, my U.S. Pat. No. 3,594,106 discloses a space between the lower corner of the blade and the lower corner of the slot in which it is fitted together with small projections on the blade in the form of small cylindrical buttons of a soft resilient elastomer which serve to keep the blade in contact with the supporting wall of the slot but which yield to a limited degree under pressure. Thus, instead of the inner portions of the blade being fully supported by the wall of the slot as in my two earlier patents referred to above when being driven under pressure, the inner portions of the blade are yieldingly supported by the wall of the slot, the yield being a function of the applied pressure and cooperating with the stop means provided by the outer inclined edge of the slot in the sense of tending to pivot the blade about this inclined edge in the direction opposite to that in which the pressure applied to the outer unsupported part of the blade tends to turn the blade. This structure materially reduces the wear of the blades and enhances the life of the motor under field operating conditions. In each of the above-mentioned patents the discharge ports are located immediately before the leading ends of the separators and the blade strikes the separator with great force, thus producing considerable wear on both the blade and separator.

SUMMARY OF THE INVENTION

I have found that the life of the blades and motor can be significantly improved, quite unexpectedly, by locating the stop means which limits the travel of the blade under pressure at the center of pressure of the blade and by leaving the inner portion of the blade between the stop means and the lower corner of the slot totally unsupported by the rotor body, the blade having a reinforcing plate exposed on its leading face to engage the stop means and serving to hold the blade in spaced relationship with respect to the supporting wall of the slot. Thus, a cavity is provided between the leading face of the free portion of each blade, the lower corner of the slot and the stop means, the cavity accommodating limited inward displacement of the free portion of the rotor blade in its direction of width to prevent the blade binding with the wall of said bore. The reinforcing means preferably extends inwardly into the cavity but is spaced from the lower corner to form a tail and is secured to the free portion of the blade outwardly of the stop means to allow the tail to move out of fluid pressure supporting relationship with the free portion of the blade when the free portion swings out of frictional sealing engagement with the wall of the bore.

In one particularly advantageous embodiment, the discharge ports for the liquid mud are spaced a short distance circumferentially from the separators defining the motor chambers so that as a blade approaches a spacer it sweeps liquid mud out through the discharge ports and then, when its leading end passes the discharge ports it traps a small quantity of liquid mud between itself and the separator. The pressure build up in this small quantity of liquid mud as the blade continues its motion toward the separator has the effect of commencing the folding of the blade inwardly towards its folded position as the driving liquid on the driving face of the blade is escaping through the discharge port which the blade is passing. This significantly reduces the impact of the blade on the spacer strip and materially reduces wear and vibration in the motor.

Thus it is seen that a main object of my invention is to provide a fluid driven motor having increased life.

This and other objects will be more apparent after referring to the following specification and attached drawings in which.

Figure 1:
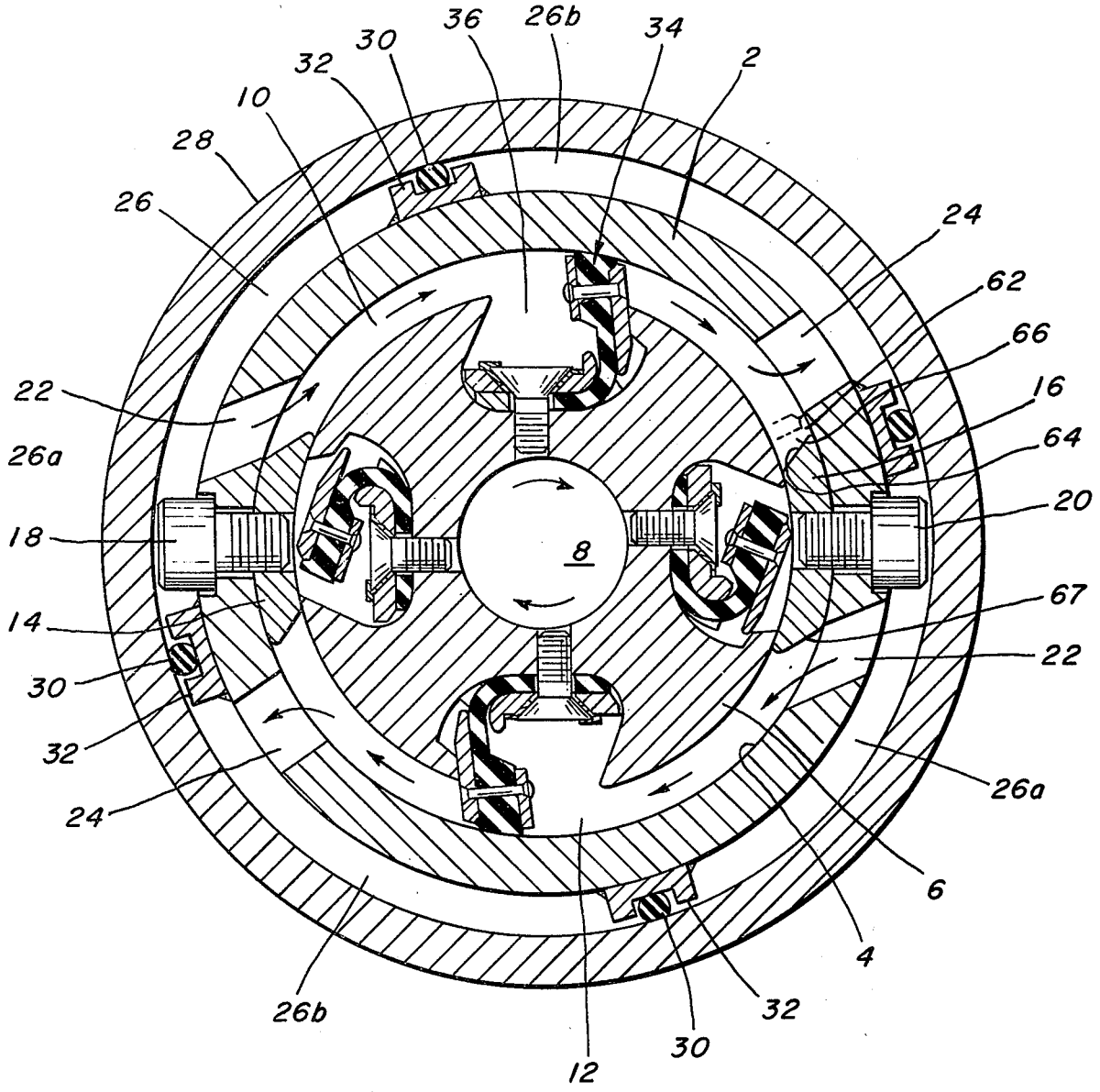
FIG. 1 is a transverse sectional view of the motor of my invention taken through the rotor.

Referring more particularly to the drawings reference numeral 2 indicates a cylindrical motor housing having a cylindrical bore 4 therein for receiving a cylindrical rotor 6. The rotor 6 has an axial bore 8 therein which may be used as a bypass for fluid as required. The rotor 6 is of smaller diameter than the bore 4 so as to provide a circumferential annular space which is divided into two like chambers 10 and 12 by diametrically opposed longitudinally extending separator strips 14 and 16 which are fastened to the cylindrical bore 4 by the screws 18 and 20, while allowing minimum clearance with the rotor 6. Each chamber 10 and 12 is provided with a set of inlet ports 22 and a set of discharge ports 24, each set being formed in the wall of the housing 4 as a plurality of longitudinally spaced apertures to place the chambers 10 and 12 in communication with a space 26 between the outside of housing 2 and well casing 28. The structure so far described is basically the same as in my prior patents. The structure for driving the rotor and handling the driving liquid may be the same as in my prior patents and since they form no part of the present invention are not being described or illustrated herein.

The space 26 is divided into longitudinal inlet passages **26*a* and discharge passages 26*b* by a resilient sealing member 30 located in a U-shaped retaining member 32, the sealing member 30 making a fluid sealing contact with the inner surface of the casing, assisted by the difference in pressure on opposite sides thereof. The sealing member 30 is a continuous member unbroken throughout its length, and is of constant cross-sectional shape throughout its length, and follows a path between the sets of inlet ports 22 and discharge ports 24 in a longitudinal direction. Means not forming part of the present invention may be provided to insure that the fluid pressure at each discharge port 24 of a longitudinally spaced set of such ports tends to be equal and that the fluid pressure resisting rotation of the rotor blades is substantially equal along the length thereof. The result of this is to materially minimize any tendency of blades 34** to distort due to unequal loading.

Four substantially V-shaped blades 34 are mounted equi-angularly about the periphery of the rotor 6 in longitudinally extending slots or grooves 36 formed in the surface of the rotor. Each groove 36 has a substantially planar base 38 which is normal to a radius of the rotor and which is tangential to an arcuate part 40 of that wall of the groove 36 which may be considered the leading wall considered in the direction of rotation of the rotor 6. This arcuate part 40 terminates at the periphery of the rotor in a stop portion 42 which projects into the groove 36 and provides a planar face 44 against which the blade 34 is supported with its outer edge in sweeping contact with the wall of the bore 4.

Each blade 34 is principally made of an elastic material 46, preferably reinforced with fabric and, when assembled in the motor, is substantially of V-shape in cross-section with the apex of the V curved. Each blade 34 is mounted and secured in a groove 36 by its inner leg 34A which is held in closely bedded engagement with planar base 38 of the groove by a metallic strip 48 secured to the rotor body by screws 50 and having a curved or beaded edge **48*a* against which the curved apex of the blade 34 rests. The outer or free limb 34*b* of each blade 34 is the operative or pressure transmitting part of the blade and, in addition to being of greater thickness towards its outer end is also reinforced by reinforcing plates 52 and 54 on the leading and trailing faces respectively and secured by a line of rivets 56 extending through the blade. The reinforcing plate 52 on the leading face of the blade portion 34*b* is arranged to abut the face 44 of stop means 42 when in its outer or driving position and protect the elastomeric material against wear. Furthermore the stop means 42 is located to provide support at the center of pressure of operative blade portion 34*b* when in its driving position to eliminate any moments generated by fluid pressure which might otherwise tend to rock the blade portion 34*b* about the stop means 42.**

Because the stop means 42 projects into the grooves 36, the blade portion **34*b* is maintained in spaced relationship with respect to the arcuate part 40 of the groove so that a cavity 58 is defined between the stop means 42, the arcuate part 40 of the wall of the groove and the leading face of the blade portion 34*b*. The leading reinforcing strip 52 extends into the cavity 58 providing a tail 52*a* which supports the blade portion 34*b* when in its outer driving position. However, the line of rivets 56 is located outwardly of the stop means 42 so that when the blade portion 34*b* folds inwardly upon engagement with a separator strip 14 or 16, the tail 52*a* moves away from the elastic member 46 of blade portion 34*b* and sweeps the cavity 50. The width of the reinforcing strip 52 including the tail 52*a*, i.e., the dimension which is substantially radial of the rotor 6, is further selected such that as the blade portion 34*a* folds inwardly the tail 52*a* engages the inwardly projecting stop means 42 and so defines the limit of such inward folding. The peripheral width of the outer end of blades 34 is less than the peripheral width of discharge ports 24.**

Figure 2:
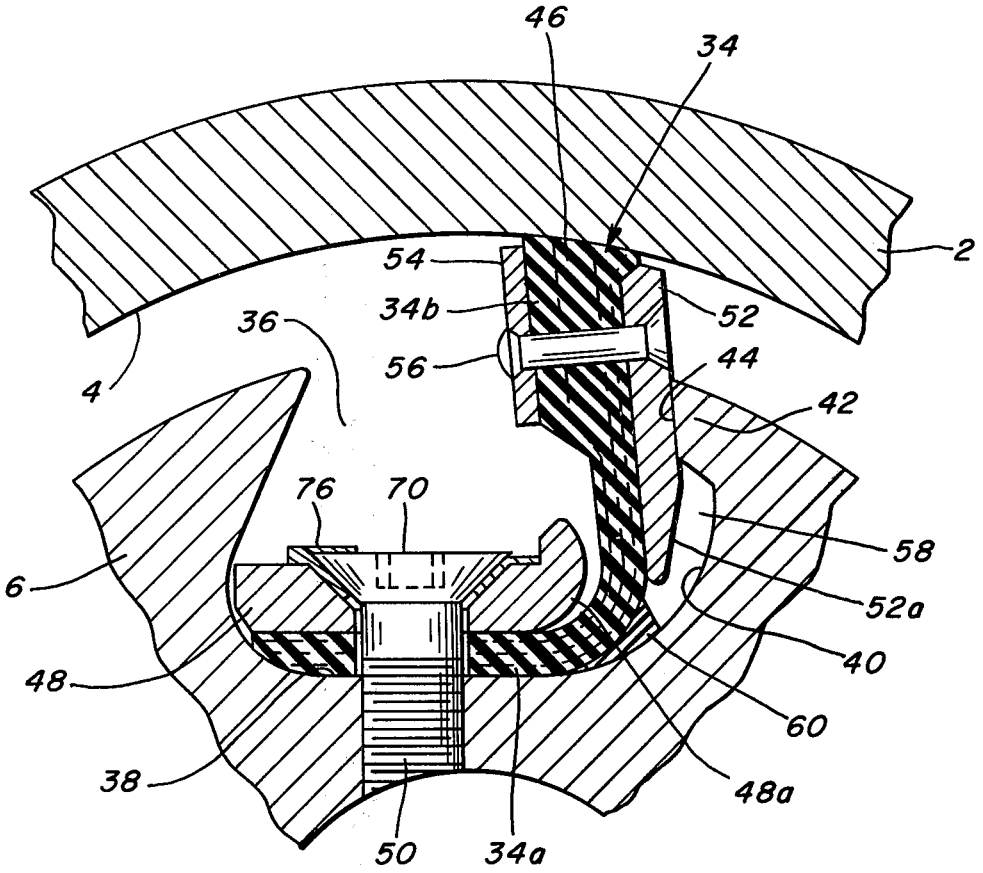
FIG. 2 is an enlarged sectional view showing a detail of the motor of FIG. 1.

As can be most clearly seen in FIG. 2, the apex of the blade 34 is spaced a short distance from the corner of the cavity 58. Also, the operative blade portion **34*b* is not supported by the wall of the groove 36 except by the projection of stop means 42. At operative fluid pressures of the order of 400 p.s.i., it will be appreciated that a considerable driving force is generated tending to drive the blade through any imperfections in the wall of the bore 4 and any particles of sand or grit which may become trapped where the sealing edge of the blade sweeps the wall of the bore 4. This tendency promotes wear at the sealing edge of the blade and it is an important feature that this is minimized by the construction described which allows a limited but inward movement of the blade portion 34*b* if it should encounter an obstruction at its sealing edge. This inward movement is in the direction of width of the blade portion 34*b*, i.e., substantially radially of the rotor 6 in which direction there is substantially no fluid pressure to be overcome. This radially inwardly movement of the blade portion 34*b* may be further controlled by the provision of resilient means between the edge of the blade portion 34***a* where it joins the apex and the junction of the planar base 38 of the groove 36 with the arcuate wall 40. This resilient means conveniently takes the form of small spaced buttons 60 formed of elastomeric material on the under face of the blade portion 34*a* and substantially radially in line with the width of the blade portion 34*b* so that any radially inward motion of the blade portion 34*b* is resisted and absorbed in a controlled manner by the buttons 60.

As shown in FIG. 1, each discharge port 24 is circumferentially spaced a short distance 62, in advance of the associated separator strip 14 or 16 and that the leading edge 64 of each such separator strip is chamfered or slopes inwardly away from the approaching blade. The effect of this is that as a blade 34 approaches a discharge port 24 it sweeps fluid out through that port until its leading face has passed the port. At that instant, a substantially closed cavity 66 is formed between the leading face of the blade portion 34*b* and the separator strip 14 or 16 and the rotor 6 in which some fluid is trapped. Progressive movement of the rotor 6 and the blade portion 34*b* builds up the fluid pressure in cavity 66 and as the trailing face of the blade portion 34*b* is open to the discharge port 24 and no longer exposed to substantial fluid pressure, the blade portion commences to fold progressively under the influence of the increasing pressure of the trapped fluid. Thus the blade portion 34*b* has already commenced to fold by the time the reinforcing plate 52 strikes the chamfered part 64 of the separator strip thereby materially reducing wear on the blade and vibration of the motor.

The trailing edge 67 of each separator strip preferably slopes inwardly away from the approaching blade 34. This is a safety feature in case of mud pump failure at the surface. In case of such failure the blades can then function as ratchet pawls to drive the drill bit by rotating the drill string from the surface to keep it from sticking.

Figure 3:
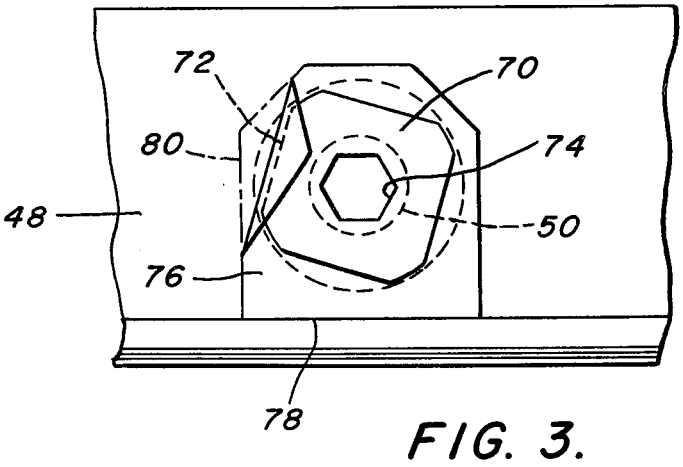
FIG. 3 is a fragmentary plan view illustrating a blade fastening means.

The fastening means illustrated in FIG. 3 is particularly useful in securing the blades 34 to the rotor 6. As shown therein, the metallic strip 48 is secured to the rotor body by bolts 50 provided at intervals along its length. These bolts have heads 70 with at least one flat 72 formed thereon. The bolts 50 have a square head with a central hexagonal hole 74 whereby they are secured in position with the aid of a suitable tool. Between the head 70 and the fastening strip 48 is a locking washer 76 which has at least one rectilinear edge 78 and in this embodiment, the locking washers 76 cannot rotate. When the bolt 50 has been screwed down to secure the fastening strip 48 to the rotor body with the limb 34*a* of the blade sandwiched therebetween, a portion of the locking washer 76 is folded over the flat 78 on the bolt head 71 (as shown in broken lines 80) thereby positively locking the bolt 50 in place.

In the operation of the motor described, driving fluid, e.g., liquid mud, enters through the inlet ports 22 forcing the blade portions 34*b* outwardly into sealing engagement with the wall of the bore 4 and the reinforcing plates 52 into driving engagement with the face 44 of stop means 42 located at the center of pressure to drive the rotor. Any imperfections in the wall of the bore 4 and any grit or sand particles at the sealing edge of the blades are accommodated by controlled radially inward displacement of the blade portions 34*b*. As the leading end of the blades pass a discharge port 24 trapped fluid commences to fold the blade portions 34*b* inwardly before they strike a separator strip 14 or 16 which continues the folding operation. During the inward folding of the blade portions 34*b* the tail 52*a* of the reinforcing strip sweeps the cavity 58 and prevents accumulation of sand or grit therein. Also the tail 52*a* strikes the stop means 42 and limits the inward folding of the blade portion 34*b*.

It will be appreciated that the motor described may be equally used as a pump to drive fluid, in which case the rotor 6 is driven by some external power source and the advantages described in relation to the motor are equally applicable to a pump.

It is to be understood that the above description is by way of example only and that details for carrying the invention into effect may be varied without departing from the scope of the invention claimed.

I claim:

1. A fluid motor or pump comprising a housing having a bore, a rotor body mounted for rotation in said bore and defining therewith an annular space, longitudinally extending separator strips mounted on said housing in said bore and dividing said annular space into at least two chambers, inlet ports opening through said housing to each chamber adjacent the trailing edge of each separator strip considered in the direction of rotor rotation, outlet ports opening through said housing to each chamber spaced circumferentially a short distance from the leading edge of each separator strip, a plurality of circumferentially spaced longitudinally extending grooves formed in the rotor surface, each groove having a base and a leading wall portion, stop means carried on said leading wall portion in radially outwardly spaced relationship to said base and extending into said groove, a resilient blade of substantially V-shape in cross-section mounted in each groove with one leg secured to said base and the other leg urged against said stop means at its center of pressure and having a free edge for sealingly engaging the wall of said bore, said other leg being maintained in spaced relationship with said leading wall portion by engagement with said stop means and defining with said stop means and said leading wall portion a cavity, said one and other legs of said blade meeting at a curved apex spaced from said base and said leading wall portion allowing inward displacement of said other leg into said cavity against the inherent resilience of said blade.

2. In a fluid motor or pump having a housing with a hollow bore therein, a rotor body mounted for rotation in said bore, a plurality of circumferentially spaced longitudinally extending blades mounted in grooves on the outer periphery of said rotor body, each of said blades having a part made of a resilient flexible material and having one of its longitudinal edges secured to said rotor body to form a blade corner about which said blade is flexed and the free portion of the blade pivots due to its resilience to swing its other longitudinal edge into frictional sealing engagement with the wall of said bore, reinforcing means provided for each blade to limit bending due to fluid pressure, and stop means mounted on said rotor body and associated with each of said blades to engage the free portion of said blade to limit its angle of swing, the improvement comprising locating said stop means at the center of pressure of the free portion of each of said blades, extending said stop means circumferentially from said rotor body into said groove to provide an inner shoulder, and providing said reinforcing means on the leading face of said free portion of each blade for direct engagement with said stop means and to maintain the free portion of each blade in spaced and unsupported relationship with respect to the grooves in said rotor body to define a cavity between the leading face of the free portion of each blade, said blade corner, said inner shoulder and the wall of said groove, said cavity accommodating limited inward displacement of the free portion of the rotor blade in its direction of width to prevent said blade binding with the wall of said bore.

3. The combination of claim 2, in which said reinforcing means extends inwardly into said cavity a distance short of said blade corner to form a tail, and said improvement includes means securing said reinforcing means to said free portion of the resilient flexible part of said blade only outwardly of said stop means to allow said tail to move out of fluid pressure supporting relationship with said free portion of the blade when said free portion swings out of frictional sealing engagement with the wall of said bore.

4. The combination of claim 3 including resilient means operable to absorb and control said inward displacement of said rotor blade.

5. A motor or pump as claimed in claim 2 in which each discharge port is located a short distance from a separator strip on the leading side thereof so as to provide a closed cavity between the trailing edge of the port and the separator strip when the leading side of a blade passes the discharge port, thereby trapping fluid in the cavity to act as a buffer.

6. A motor or pump as claimed in claim 5 in which the leading edge of each separator strip slants inwardly away from the direction of blade approach so as to produce a smooth transition of the blade from the bore contacting position to the separator strip contacting position as the rotor rotates.

7. A fluid motor or pump comprising a housing having a bore, a rotor body mounted for rotation in said bore and defining therewith an annular space, a plurality of circumferentially spaced longitudinally extending blades mounted in slots on the outer periphery of said rotor body, each of said blades being made of a resilient flexible material and having one of its longitudinal edges secured to said rotor body to form a blade corner about which said blade is flexed and the free portion of the blade pivots due to its resilience to swing its other longitudinal edge into frictional sealing engagement with the wall of said bore, longitudinally extending separator strips mounted on said housing in said bore and dividing said annular space into at least two chambers, inlet ports opening through said housing to each chamber adjacent the trailing edge of each separator strip considered in the direction of rotor rotation, and outlet ports opening through said housing to each chamber spaced a short distance from the leading edge of each separator strip on the leading side thereof so as to provide a closed cavity between the trailing edge of the port and the separator strip when the leading side of a blade passes the discharge port, thereby trapping fluid in the cavity to act as a buffer.

8. A motor or pump as claimed in claim 7 in which the leading edge of each separator strip slants inwardly away from the direction of blade approach so as to produce a smooth transition of the blade from the bore contacting position to the separator strip contacting position as the rotor rotates.

9. A fluid motor or pump according to claim 7 in which the peripheral width of the outer ends of said blades is less than the peripheral width of said discharge ports.

10. A motor or pump as claimed in claim 9 in which the leading edge of each separator strip slants inwardly away from the direction of blade approach so as to produce a smooth transition of the blade from the bore contacting position to the separator strip contacting position as the rotor rotates.

11. A motor or pump as claimed in claim 7 in which the trailing edge of each separator strip slants inwardly away from the direction of blade approach.

12. A motor or pump as claimed in claim 11 in which the leading edge of each separator strip slants inwardly away from the direction of blade approach so as to produce a smooth transition of the blade from the bore contacting position to the separator strip contacting position as the rotor rotates.

* * * * *